US006537236B2

(12) United States Patent
Tucek et al.

(10) Patent No.: US 6,537,236 B2
(45) Date of Patent: Mar. 25, 2003

(54) CHIROPRACTIC ADJUSTOR APPARATUS HAVING HOUSING CONFIGURED FOR ENHANCED HEAT DISSIPATION AND SYMMETRICAL FORCE-TRANSMITTING SHAFT SUPPORT

(76) Inventors: Kevin B. Tucek, 3498 N. San Marcos Pl., #6, Chandler, AZ (US) 85225; John W. Brimhall, 1618 E. Fairfield, Mesa, AZ (US) 85203

( * ) Notice: Subject to any disclaimer, the term of this patent is extended or adjusted under 35 U.S.C. 154(b) by 0 days.

(21) Appl. No.: 09/749,023

(22) Filed: Dec. 26, 2000

(65) Prior Publication Data

US 2002/0082532 A1 Jun. 27, 2002

(51) Int. Cl.[7] ..... A61H 7/00

(52) U.S. Cl. ..... 601/80; 601/101; 601/108; 606/239

(58) Field of Search ..... 601/97, 101, 107, 601/108, 111, 78, 80; 606/237, 238, 239; D8/59; D15/139; D24/171

(56) References Cited

U.S. PATENT DOCUMENTS

| | | | | |
|---|---|---|---|---|
| 1,796,444 A | | 3/1931 | Dell'era et al. | |
| 2,076,410 A | | 4/1937 | McGerry | 128/55 |
| 2,078,025 A | | 4/1937 | Samuels | 128/55 |
| 4,084,810 A | * | 4/1978 | Forsman | 601/23 |
| 4,088,128 A | | 5/1978 | Mabuchi | 128/52 |
| 4,549,535 A | | 10/1985 | Wing | 128/55 |
| 4,566,442 A | * | 1/1986 | Mabuchi et al. | 601/101 |
| 4,716,890 A | | 1/1988 | Bichel | 128/55 |
| 4,841,955 A | | 6/1989 | Evans et al. | 128/52 |
| 5,140,979 A | | 8/1992 | Nakagawa | 128/55 |
| 5,618,315 A | | 4/1997 | Elliott | 606/237 |

FOREIGN PATENT DOCUMENTS

| | | | |
|---|---|---|---|
| CH | 669897 A5 | 4/1989 | 601/108 |

OTHER PUBLICATIONS

Prior Art Chiropratic Adjustor Apparatus (Figs.1&1A) 2 sheets.

* cited by examiner

*Primary Examiner*—Danton D. DeMille
*Assistant Examiner*—Quang D Thanh
(74) *Attorney, Agent, or Firm*—Flanagan & Flanagan; John R. Flanagan

(57) ABSTRACT

A chiropractic adjustor apparatus includes a housing having a central interior cavity and a pair of opposite end portions oriented substantially the reverse of one another and extending in opposite directions from the interior cavity and having passages adapted to enhance heat dissipation from the housing, an electromagnetic drive mechanism mounted in the interior cavity of the housing, a force-transmitting shaft extending through the drive mechanism and opposite end portions of the housing and reciprocally supported by the opposite end portions of the housing in a substantially symmetrical relationship to the drive mechanism, an arrangement for actuating the drive mechanism to cause repetitive reciprocal vibratory movement of the shaft along a longitudinal axis thereof and relative to the housing, and a handle attached to the housing for gripping the apparatus.

14 Claims, 4 Drawing Sheets

CHIROPRACTIC ADJUSTOR APPARATUS HAVING HOUSING CONFIGURED FOR ENHANCED HEAT DISSIPATION AND SYMMETRICAL FORCE-TRANSMITTING SHAFT SUPPORT

BACKGROUND OF THE INVENTION

1. Field of the Invention

The present invention generally relates to a chiropractic adjustor apparatus for use in a chiropractic treatment to apply vibratory energy or force to the human body and, more particularly, is concerned with a chiropractic adjustor apparatus having a housing configured to enhance heat dissipation from the housing and to provide symmetrical support of a force-transmitting shaft by the housing.

2. Description of the Prior Art

Chiropractic adjustments of the spinal vertebrae of a human body involve the application of pressure or force in a known manner directly to the human body by the hands of a chiropractor or by a chiropractic adjustor apparatus used by the chiropractor. Examples of such chiropractic adjustor apparatuses found in the prior patent art are those disclosed in U.S. Pat. No. 4,716,890 to Bichel and U.S. Pat. No. 4,841,955 to Evans et al.

Another example of a prior art chiropractic adjustor apparatus is the one illustrated in FIG. 1. The apparatus of FIG. 1, generally designated 10, basically includes a housing 12 defining an interior cavity 14, a handle 16 on the housing 12 for gripping by the user, a trigger 18 reciprocally mounted to the handle 16 for actuation by the user, an electronic control module 20 provided in the handle 16 and activated by depression and release of the trigger 18, an elongated force-transmitting shaft 22 reciprocally mounted through the housing 12 and through the interior cavity 14 thereof, and an electromagnetic drive mechanism 24 disposed in the interior cavity 14 and connected electrically to the electronic module 20 and operable by the actuation of the trigger 18 and the return action of a compressible spring 26 disposed between a rear end 22A of the shaft 22 and a rear portion 12A of the housing 12 to cause the shaft 22 to transmit vibratory energy to the human body.

The electromagnetic drive mechanism 24 includes a spool 28 with electrical windings 30 stationarily supported in the interior cavity 14 of the housing 12 and a stator 32 mounted on the shaft 22 and disposed within a bore 34 of the spool 28 in an electromagnetically coupled relationship with the electrical windings 30 about the spool 28 such that depressing the trigger 18 activates the electrical control module 20 to apply predetermined pulses to the electrical windings 30 so as to actuate the stator 32 and thus the shaft 22 into repetitive reciprocal vibratory type of movement along a longitudinal axis A of the shaft 22 and relative to the housing 12.

The operation of the electromagnetic drive mechanism 24 creates substantial heating of the electrical windings 30 which, in turn, heats the portions of the housing 12 adjacent thereto. The buildup of heat must be dissipated from the housing 12 in order to prevent overheating of the handle 14 connected thereto and of the electronic control module 20 disposed in the handle 14. Unsatisfactory dissipation of the heat would make it uncomfortable and difficult for a chiropractor to hold onto the handle 14 for an extended period of time and have the potential to cause a malfunction of the electronic control module 20. A plurality of passages 36 are provided through the rear portion 12A of the housing 12 to facilitate passage and dissipation of heat from the drive mechanism 24 and housing 12.

However, the provision of the passages 36 through only the rear portion 12A of the housing 12 appears to be inadequate to handle the heat dissipation task. Furthermore, a forward portion 22B of the shaft 22 is supported by a forward portion 12B of the housing 12 substantially closer to the electromagnetic drive mechanism 24 in the housing 12 than the rearward portion 12A of the housing 12 which supports a rearward portion 22C of the shaft 22. This results in a substantially asymmetrical supporting relationship of the shaft 22 by the housing 12.

Consequently, a need exists for an innovation that will provide a housing configuration that will overcome the aforementioned problems of the prior art chiropractic adjustor apparatus without introducing any new problems in place thereof.

SUMMARY OF THE INVENTION

The present invention provides a chiropractic adjustor apparatus designed to satisfy the aforementioned need. The apparatus of the present invention has a housing with reversely-oriented, preferably conical-shaped, opposite end portions having passages adapted to enhance heat dissipation. The apparatus also has a force-transmitting shaft which is substantially symmetrically supported by the opposite end portions of the housing in relation to an electromagnetic drive mechanism disposed in the housing.

Accordingly, the present invention is directed to a chiropractic adjustor apparatus which comprises: (a) a hollow housing having a central interior cavity and a pair of opposite end portions oriented substantially the reverse of one another and extending in opposite directions from the interior cavity, the opposite end portions each having passages adapted to enhance heat dissipation from the housing; (b) an electromagnetic drive mechanism mounted in the interior cavity of the housing; (c) a force-transmitting shaft extending through the drive mechanism and opposite end portions of the housing and reciprocally supported by the opposite end portions of the housing, preferably in a substantially symmetrical relationship to the drive mechanism; (d) an arrangement for actuating the drive mechanism to cause repetitive reciprocal vibratory movement of the shaft along a longitudinal axis thereof and relative to the housing; and (e) means attached to the housing for gripping to hold the apparatus.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
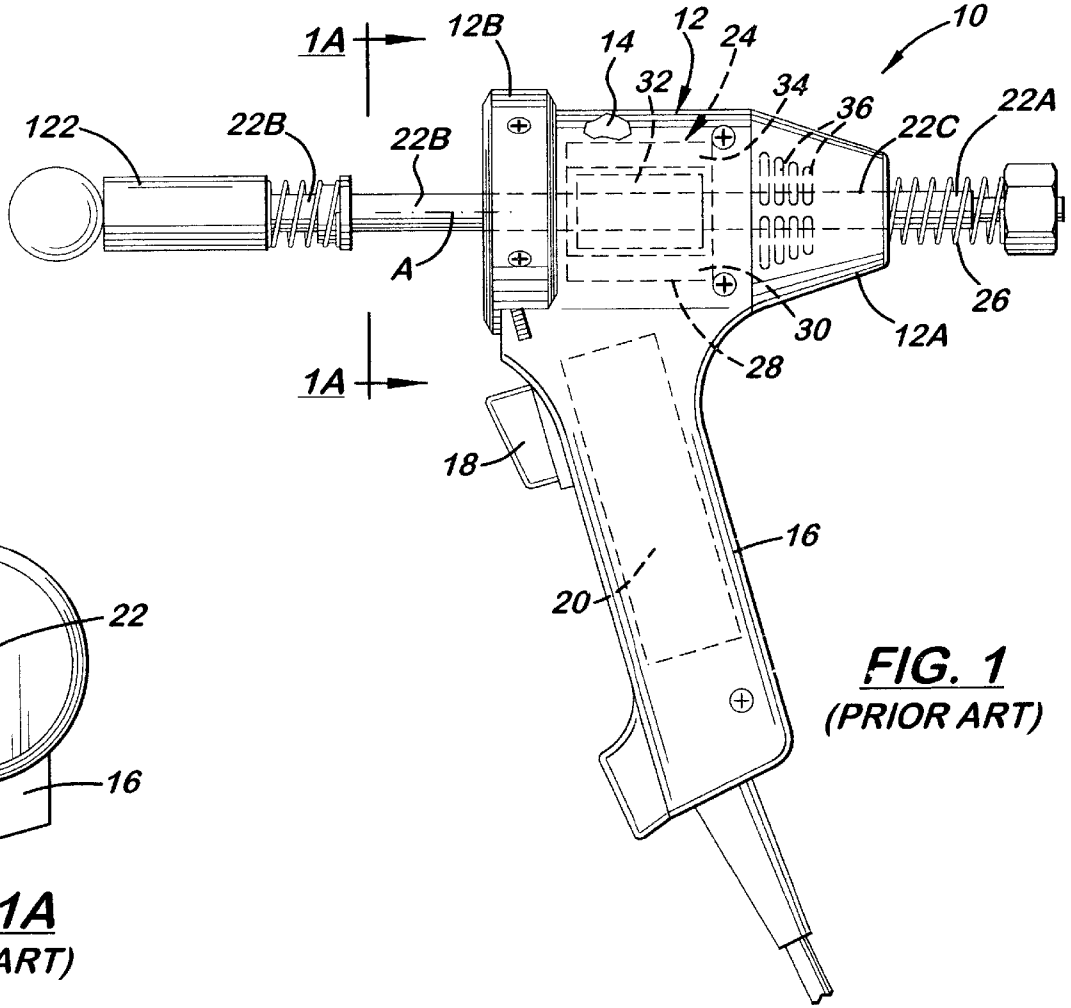
FIG. 1 (PRIOR ART)
FIG. 1 is a side elevational view of the prior art chiropractic adjustor apparatus that has been described in detail in the background section of this application.
Figure 1A:
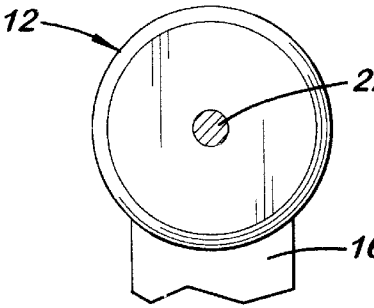
FIG. 1A (PRIOR ART)
FIG. 1A is an end elevational view as seen along line 1A—1A of FIG. 1.
Figure 2:
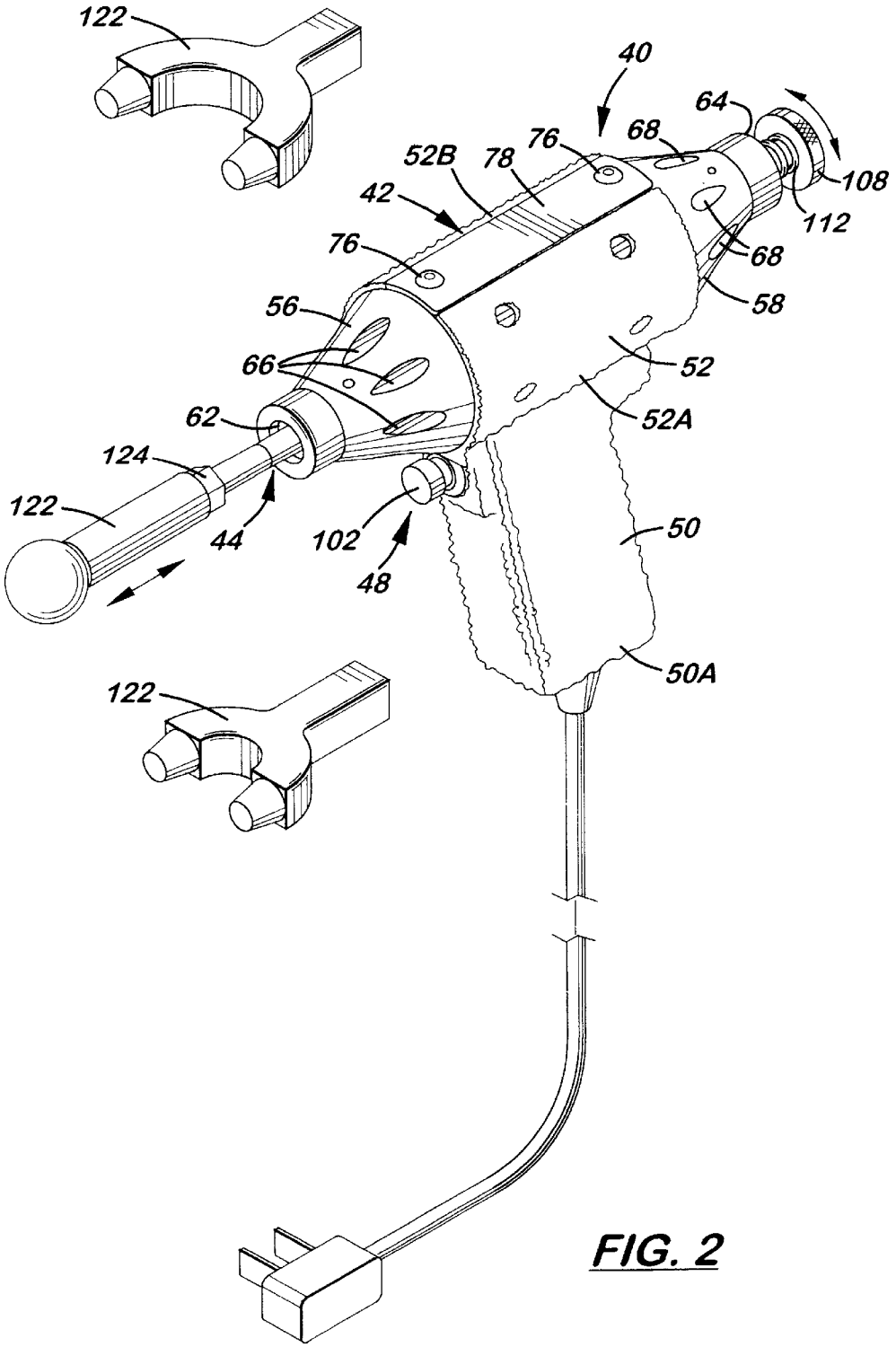
FIG. 2 is a perspective view of a chiropractic adjustor apparatus of the present invention showing different heads which can be used with the apparatus.
Figure 3:
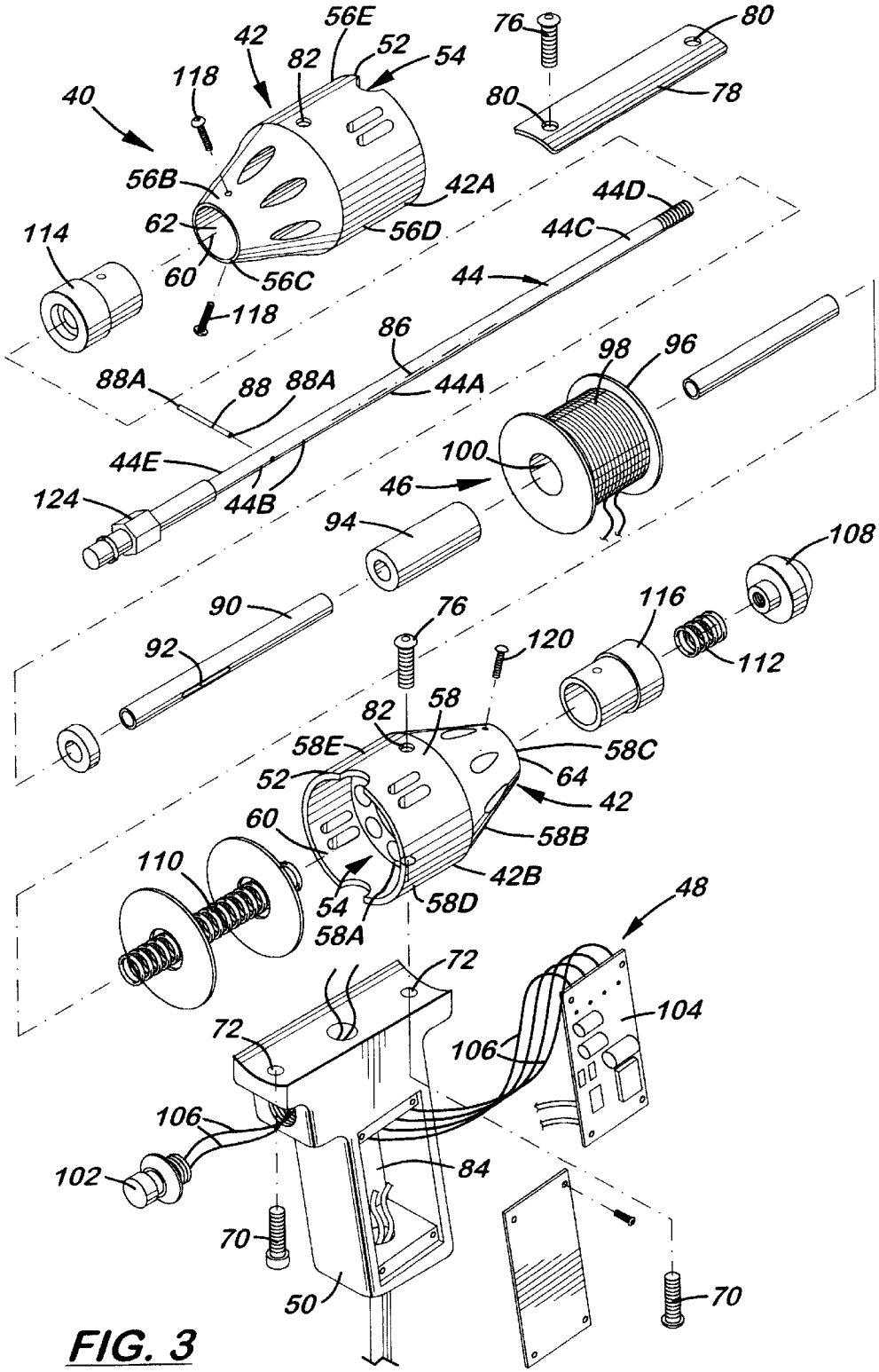
FIG. 3 is an exploded perspective view of the apparatus of FIG. 2.
Figures 4, 5:
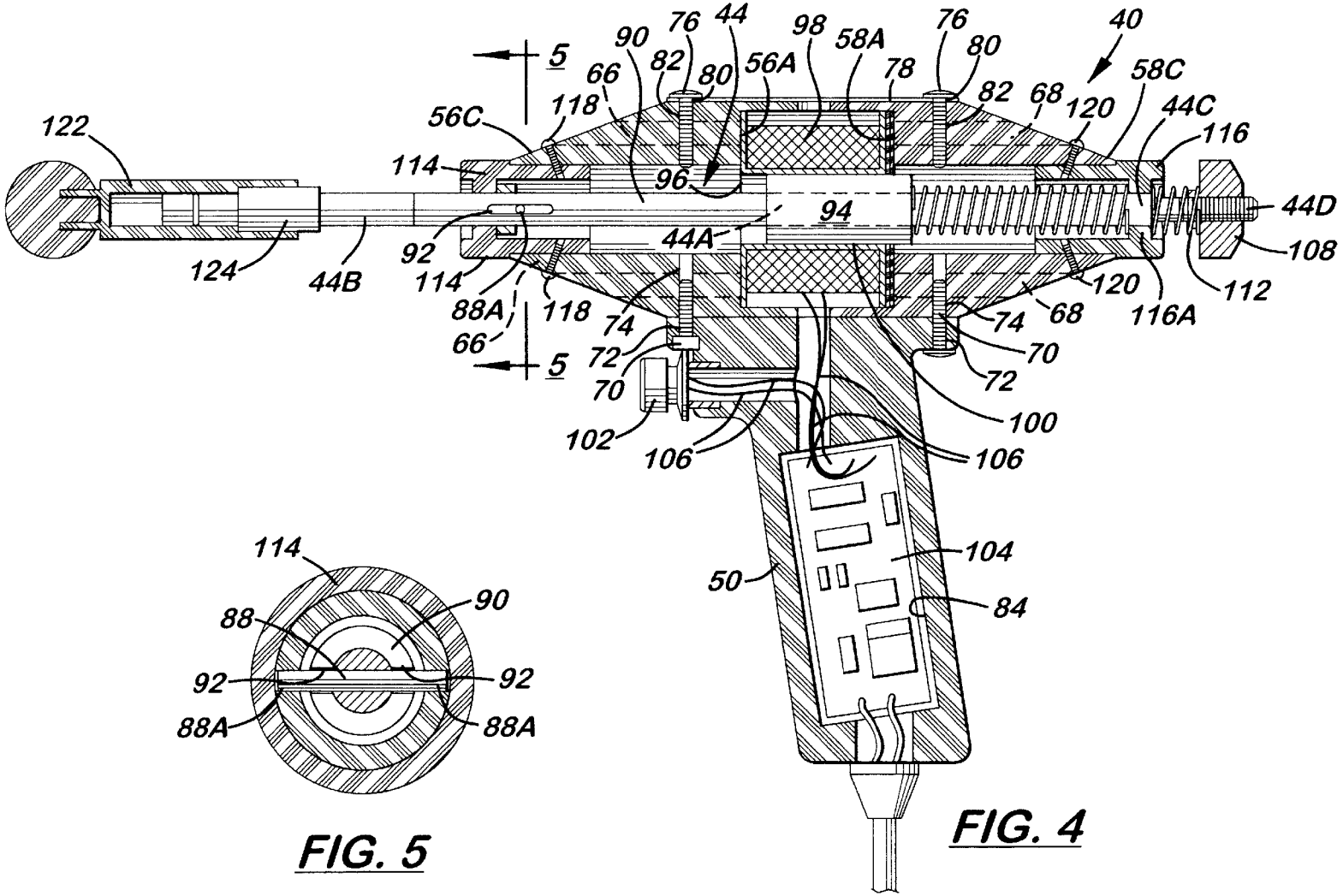
FIG. 4 is a longitudinal sectional view of the apparatus of FIG. 2.
FIG. 5 is an enlarged cross sectional view of the apparatus taken along line 5—5 of FIG. 4.

Referring to the drawings and particularly to FIGS. 2 to 5, there is illustrated a chiropractic adjustor apparatus of the present invention, generally designated 40. The apparatus 40 of the present invention basically includes a housing 42, an elongated force-transmitting shaft 44, an electromagnetic drive mechanism 46, an actuating arrangement 48 and a gripping means in the form of a handle 50.

The housing 42 of the apparatus 40 has a middle portion 52 defining a central interior cavity 54 and a pair of opposite (or front and rear) end portions 56, 58 merging from the middle portion 52. The opposite end portions 56, 58 are oriented substantially the reverse of one another relative to the middle portion 52 so as to extend in opposite directions from the middle portion 52 and the interior cavity 54. The opposite end portions 56, 58 are spaced apart from one another by the middle portion 52 and together with the middle portion 52 are coaxially aligned with one another about a longitudinal axis 60 of the housing 42. The opposite end portions 56, 58 have respective inner surfaces 56A, 58A spaced apart from one another by the central interior cavity 54 and extending generally parallel to one another and extending about and perpendicular to the longitudinal axis 60 of the housing 42. The opposite end portions 56, 58 further have respective outer surfaces 56B, 58B of conical shapes spaced in opposite directions from the respective inner surfaces 56A, 58A and reversely oriented with respect to one another and extending about and along the longitudinal axis 60 of the housing 42 such that the opposite end portions 56, 58 are substantially mirror images of one another. The opposite end portions 56, 58. still further have respective central openings 62, 64 and respective pluralities of axially extending passages 66, 68. The central openings 62, 64 extend through the opposite end portions 56, 58 in opposite directions from the respective inner surfaces 56A, 58A to respective outer ends 56C, 58C thereof. The central openings 62, 64 of the respective opposite, or front and rear, end portions 56, 58 are aligned with one another and extend parallel with the longitudinal axis 60 of the housing 42. The passages 66, 68 of each plurality thereof extend between and open at the respective inner and outer surfaces 56A, 58A and 56B, 58B of the opposite end portions 56, 58 of the housing 42 and extend substantially parallel with the longitudinal axis 60 of the housing 42 and are circumferentially spaced apart from one another about and displaced radially outwardly from the longitudinal axis 60 of the housing 42 and the central openings 62, 64 through the opposite end portions 56, 58 of the housing 42. Such passages 66, 68 are adapted to enhance heat dissipation from the housing 42. The middle portion 52 of the housing 42 is substantially cylindrical in shape and the opposite (or front and rear) end portions 56, 58 of the housing 42 are reversely-oriented and substantially conical in shape. More particularly, the housing 42 is formed by a pair of front and rear housing parts 42A, 42B being substantially identical in shape which are arranged in a mirror-image back-to-back relationship and in a reverse orientation with one another so as to define together the central interior cavity 54. The housing parts 42A, 42B are assembled together by fastening means in the form of a first pair of screws 70 which fixedly attach the handle 50 on lower sides 56D, 58D of the opposite end portions 56, 58 of the housing 42 via alignable holes 72, 74 defined in the handle 50 and the lower sides 56D, 58D of the opposite end portions 56, 58 of the housing 42 such that the handle 50 underlies and bridges the housing parts 42A, 42B in assembling the housing parts 42A, 42b together and by fastening means in the form of a second pair of screws 76 which fixedly attach an attachment member in the form of a curved plate. 78 on upper sides 56E, 58E of the opposite end portions 56, 58 of the housing 42 via alignable holes 80, 82 defined in the plate 78 and the upper sides 56E, 58E of the opposite end portions 56, 58 of the housing 42 such that the curved plate 78 overlies and bridges the housing parts 42A, 42B in assembling the housing parts 42A, 42B together. The handle 50 also has an interior compartment 84.

The elongated force-transmitting shaft 44 extends through the electromagnetic drive mechanism 46, through the middle portion 52 and interior cavity 54 of the housing 42, and through the central openings 62, 64 in the opposite (front and rear) end portions 56, 58 of the housing 42. In such manner, the shaft 44 is reciprocally supported by the opposite end portions 56, 58 of the housing 42, preferably in a substantially symmetrical relationship to the electromagnetic drive mechanism 46. The shaft 44 defines a longitudinal axis 86 which extends coaxially along the longitudinal axis 60 of the housing 42. More particularly, the shaft 44 has a middle portion 44A disposed in the interior cavity 54 of the housing 42 and a pair of opposite (or forward and rearward) portions 44B, 44C extending in opposite directions from the interior cavity 54 and through and outwardly from the central openings 62, 64 of the opposite (or front and rear) end portions 56, 58 of the housing 42. A pin 88 is mounted across the forward portion 44B of the shaft 44 in a transverse relationship thereto. A sleeve 90 extends about and along the forward portion 44B of the shaft 44 and has a longitudinal slot 92 receiving an end 88A of the pin 88 such that the shaft 44 can undergo longitudinal movement through the sleeve 90 along the longitudinal axes 60, 84 of the housing 42 and shaft 44 but not undergo rotation about the axes 60, 84 and relative to the sleeve 90 and thus to the housing 42.

The electromagnetic drive mechanism 46 is mounted in the central interior cavity 54 of the housing 42. The drive mechanism 46 includes a stator 94, a spool 96 and a series of electrical windings 98 disposed about the spool 96. The spool 96 is stationarily supported by the housing 42 in the central interior cavity 54 of the housing 42 at the cylindrical middle portion 52 thereof. The spool 96 has a central bore 100 defined therethrough aligned with the central openings 62, 64 at the opposite (or front and rear) end portions 56, 58 of the housing 42. The stator 94 is fixedly mounted on the shaft 44 about the middle portion 52 thereof and extends through the central bore 100 of the spool 96 in an electromagnetically coupled relationship with the electrical windings 98 about the spool 96 whenever an electrical current is moving through the windings 98.

The actuating arrangement 48 is mounted to the handle 50, is electrically connected to the electrical windings 98 of the electromagnetic drive mechanism 46, and is operable to actuate the drive mechanism 46 to cause repetitive reciprocal vibratory movement of the shaft 44 along its longitudinal axis 86 relative to the housing 42. The actuating arrangement 48 includes a trigger 102 reciprocally mounted to the handle 50 at a front upper location thereon immediately below the front end portion 56 of the housing 42. The trigger 102 extends from the exterior of the handle 50 into the interior compartment 84 of the handle 50. The actuating arrangement 48 also includes an electronic control module 104 provided in the interior compartment 84 of the handle 50 and an electrical power supply cable 106 connected to the module 104 through the bottom end 50A of the handle 50. Conductive wires 106 extending through passageways 50B, 50C in the handle 50 interconnect the trigger 102, module 104 and electrical windings 98 on the spool 96 so as to form an electrical circuit therebetween. The trigger 102 is an electrical switch biased to normally assume an extended position in which the electrical circuit is maintained in a non-conductive or broken condition. The electrical circuit is closed and thus the module 104 is activated and the electrical windings 98 are energized by depressing the trigger 102. When the trigger 102 is depressed, the electronic control module 104 is activated to apply predetermined pulses to the electrical windings 98 so as to actuate the stator 94 and thus the shaft 44 into repetitive reciprocal vibratory type of movement relative to the housing 42.

The force applied by the elongated shaft 44 can be adjusted by the incorporation in the apparatus 40 of an arrangement in the form of a knob 108 disposed on a rear end 44D of the shaft 44 and first and second springs 110, 112 disposed about the rearward portion 44C of the shaft 44 respectively interiorly between the stator 94 and rear end 42A of the housing 42 and exteriorly between the knob 108 and rear end 42A of the housing 42. Front and rear plugs 114, 116 are fixedly secured by screws 118, 120 in the front and rear central openings 62, 64 in the front and rear end portions 56, 58. The front plug 114 provides a front stop which is abutted by the pin 88. The rear plug 116 has an internal shoulder 116A having opposite sides against which the first and second springs 110, 112 respectively abut. The knob 108 is threadable about the rear end 44D of the shaft 44 toward and away from the rear end 42A of the housing 42 such that by turning the knob 108 the return force imposed by the springs 110, 112 on the stator 94 and shaft 44 can be increased or decreased to thereby adjust the amount vibratory force applied to the human body at the front end of the shaft 44.

Also, a plurality of force transmitting elements 122 of different configurations are adapted to be fitted to a hex shaped segment 124 of the front end 44E of the shaft 44 and placed against a part of the human body to be treated. The different configurations of the elements 22 allow for the application of force in different ways to the human body. The adjustor apparatus 40 has a mode of operation similar to that of a jack hammer or the like. In the case of the apparatus 40, vibratory impacts are transmitted at the front end 44E of the shaft 44 by the selected one of the force transmitting elements 122 when it is placed against the desired part of the human body.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A chiropractic adjustor apparatus, comprising:

(a) a housing having a longitudinal axis, a central interior cavity extending about said longitudinal axis and a pair of opposite end portions oriented substantially the reverse of one another and extending in opposite directions from said central interior cavity along and about said longitudinal axis, said opposite end portions having respective inner surfaces spaced apart from one another by said central interior cavity and extending generally parallel to one another and extending about and perpendicular to said longitudinal axis of said housing, said opposite end portions further having respective outer surfaces of conical shapes spaced in opposite directions from central interior cavity and reversely oriented with respect to one another and extending about and along said longitudinal axis of said housing such that said opposite end portions are substantially mirror images of one another, said opposite end portions further having respective central openings therethrough extending in opposite directions from said central interior cavity and the housing further having passages adapted to enhance heat dissipation from said housing, said passages extending between and open at said respective outer surfaces of said opposite end portions and said central interior cavity and extending substantially parallel with said longitudinal axis of said housing and circumferentially spaced apart from one another about and displaced radially outwardly from said longitudinal axis of said housing and said openings through said opposite end portions of said housing;

(b) an electromagnetic drive mechanism mounted in said central interior cavity of said housing;

(c) an elongated force-transmitting shaft extending through said electromagnetic drive mechanism and through said openings in said opposite end portions of said housing and having opposite ends extending beyond said opposite end portions of said housing exteriorly of said housing, said shaft reciprocally supported by said opposite end portions of said housing in a substantially symmetrical relationship to said electromagnetic drive mechanism and, extending coaxially with said longitudinal axis of said housing;

(d) means for actuating said electromagnetic drive mechanism to cause repetitive reciprocal vibratory-type of movement of said shaft along a longitudinal axis of said shaft and relative to and along said longitudinal axis of said housing; and (e) means attached to said housing for gripping to hold said apparatus.

2. The apparatus of claim 1 wherein said housing, has a cylindrical-shaped middle portion defining said central interior cavity and being disposed between said reversely-oriented opposite end portions which extend in said opposite directions from said middle portion.

3. The apparatus of claim 2 wherein said gripping means is a handle attached to a lower side of the cylindrical middle portion of the housing for gripping by an operator to hold the apparatus, the handle having an interior compartment.

4. The apparatus of claim 1 wherein said gripping means is a handle attached to a lower side of the housing for gripping by an operator to hold the apparatus, the handle having an interior compartment.

5. The apparatus of claim 4 wherein said actuating means includes a trigger reciprocally mounted to said handle so as to extend from an exterior thereof into said interior compartment of said handle.

6. The apparatus of claim 5 wherein said actuating means further includes an electronic control module provided in said interior compartment of said handle and activated by depressing said trigger.

7. The apparatus of claim 1 wherein said drive mechanism includes a spool stationarily supported in said central interior cavity of said housing between said reversely-oriented opposite end portions thereof and having a central bore defined through said spool aligned with said openings through said opposite end portions of said housing.

8. The apparatus of claim 7 wherein said drive mechanism further includes a series of electrical windings disposed about said spool.

9. The apparatus of claim 8 wherein said elongated shaft extends through said central interior cavity of said housing and has a middle portion extending through said central bore of said spool and opposite portions extending from opposite ends of said spool to said opposite ends of said shaft.

10. The apparatus of claim 9 wherein said drive mechanism further includes a stator mounted on said shaft about said middle portion thereof and disposed within said bore of said spool in an electromagnetically coupled relationship with said electrical windings about said spool such that actuating said drive mechanism by applying predetermined pulses to said electrical windings actuates said stator and thus said shaft into said repetitive reciprocal vibratory type of movement relative to said housing.

11. The apparatus of claim 10 further comprising:

an arrangement in the form of a knob on a rear end of said shaft and first and second springs disposed about said rear end of said shaft respectively interiorly between said stator and a rear end of said housing and exteriorly between said knob and said rear end of said housing, said knob being threadable into said rear end of said housing such that by turning said knob a return force imposed by said springs on said stator and shaft can be increased or decreased to thereby adjust the amount of vibratory movement applied to a surface at a front end of said shaft.

12. The apparatus of claim 1 further comprising:

a plurality of force transmitting elements of different configurations each adapted to be fitted to a front end of said shaft and adapted to be placed against a part of the human body to be treated such that vibratory impacts are transmitted at said front end of said shaft by a selected one of said force transmitting elements when placed against the part of the human body.

13. A chiropractic adjustor apparatus, comprising:

(a) a housing having a central interior cavity and a pair of opposite end portions oriented substantially the reverse of one another and extending in opposite directions from said central interior cavity, each of said opposite end portions of said housing having passages adapted to enhance heat dissipation from said housing, said housing being formed by a pair of separate housing parts arranged back-to-back in a reverse orientation with one another so as to define separately said opposite end portions of the housing and together said central interior cavity between said opposite end portions;

(b) an electromagnetic drive mechanism mounted in said central interior cavity of said housing;

(c) a force-transmitting shaft extending through said electromagnetic drive mechanism and through openings in said opposite end portions of said housing and reciprocally supported by said opposite end portions of said housing in a substantially symmetrical relationship to said electromagnetic drive mechanism;

(d) means for actuating said electromagnetic drive mechanism to cause repetitive reciprocal movement of said shaft along a longitudinal axis of said shaft and relative to said housing; and (e) a handle attached to said housing for gripping to hold said apparatus, said housing parts assembled together by said handle fixedly attached on lower sides of said opposite end portions of the housing such that said handle underlies and bridges said housing parts in assembling said housing parts together and by an attachment member fixedly attached on upper sides of said opposite end portions of said housing such that said attachment member overlies and bridges said housing parts in assembling said housing parts together.

14. The apparatus of claim 13 wherein said actuating means is supported by said handle in an interior compartment in said handle.

* * * * *